United States Patent [19]

Sato et al.

[11] Patent Number: 4,729,215

[45] Date of Patent: Mar. 8, 1988

[54] YARN FOR MANUFACTURING ARTIFICIAL FURS

[75] Inventors: Kenji Sato; Seiichi Yamagata; Masaaki Sakai, all of Otsu, Japan

[73] Assignee: Toray Industries, Inc., Tokyo, Japan

[21] Appl. No.: 923,973

[22] Filed: Oct. 28, 1986

Related U.S. Application Data

[60] Division of Ser. No. 395,010, Jul. 1, 1982, abandoned, and Ser. No. 863,591, May 15, 1986, which is a continuation of Ser. No. 395,010.

[30] Foreign Application Priority Data

| | | | |
|---|---|---|---|
| Nov. 28, 1980 | [JP] | Japan | 55-166526 |
| Apr. 8, 1981 | [JP] | Japan | 56-51655 |
| May 26, 1981 | [JP] | Japan | 56-79357 |

[51] Int. Cl.[4] ..... D02G 3/04; D02G 3/22; D02G 3/36; D02G 3/38

[52] U.S. Cl. ..... 57/210; 57/2; 57/207; 57/227; 57/236; 57/252; 57/255

[58] Field of Search ..... 57/206, 207, 210, 203, 57/224, 227, 2, 236, 309, 252–257, 295, 297; 28/159, 160, 162

[56] References Cited

U.S. PATENT DOCUMENTS

| | | | |
|---|---|---|---|
| 2,737,702 | 3/1956 | Schmidt et al. | 28/162 X |
| 3,007,227 | 11/1961 | Moler | 57/255 X |
| 3,302,385 | 2/1967 | Ruddell et al. | 57/255 X |
| 3,321,448 | 5/1967 | Hebeler | 57/255 X |
| 3,965,663 | 6/1976 | Goetti | 57/256 |
| 4,356,690 | 11/1982 | Minorikawa et al. | 57/210 |
| 4,384,450 | 5/1983 | Sawyer | 57/254 |
| 4,415,611 | 11/1983 | Yamagata et al. | 28/160 X |
| 4,466,237 | 8/1984 | Sawyer | 57/254 |

*Primary Examiner*—John Petrakes
*Attorney, Agent, or Firm*—Austin R. Miller

[57] ABSTRACT

Improved yarn for manufacturing artificial fur, having underfur and guard hairs. The guard hairs have a multiplicity of staple fibers having tapered ends. The underfur fibers are shorter and of less denier. The guard hairs and underfur fibers are relatively longitudinally slidable to separate at least some of the fibers from others of the fibers.

Temporary binding means may be connected to maintain the respective fibers in continuity and resistant to longitudinal sliding separation during one or more fabrication operations.

Inactivation of the binding means breaks the continuity of said pile fibers whereupon at least some of the fibers may be longitudinally slidingly separated without being broken.

31 Claims, 25 Drawing Figures

YARN FOR MANUFACTURING ARTIFICIAL FURS

RELATED APPLICATIONS

This is a division of our U.S. application Ser. No. 395,010 filed July 1, 1982, now abandoned, and of its continuation Ser. No. 863,591, filed May 15, 1986. Further, claims directed to the looped pile method embodiment of this invention are located in copending divisional application Ser. No. 924,041, filed Oct. 28, 1986 while claims directed to the apparatus are located in copending divisional application Ser. No. 924,256, filed Oct. 28, 1986.

FIELD OF THE INVENTION

The present invention relates to an improved yarn for manufacturing artificial furs.

DESCRIPTION OF THE PRIOR ARTS

High quality genuine furs, such as mink, fox, etc., are genuine furs which are almost impossible to artificially produce, because of their excellent hand, excellent luster and special structural features, mainly due to the hair structure.

Accordingly, genuine furs still maintain their excellent position in the fur trade as high quality furs, because such genuine furs are recognized as a status symbol and can be used as an extremely high class raw material for making garments of high fashion. Therefore, many technical proposals have been put forth and research has been conducted for the purpose of creating artificial furs having excellent qualities similar to those of high quality genuine furs.

Some new technologies such as disclosed in U.S. Pat. No. 2,737,702 have been disclosed as being comparatively advanced in the field of producing artificial fur. In the technology disclosed by U.S. Pat. No. 2,737,702, a method is proposed for producing an artificial fur by means of a knitting machine from a sliver composed of staple fibers of a first group, which form a layer of guard hair of the fur, and staple fibers of a second group, which form a layer of underfur of the artificial fur. In this method, the use of a particular kind of fibers is proposed for the first group of fibers, wherein each fiber is provided with two tapered end portions. It can be recognized that the quality of this artificial fur is similar to genuine fur in that the free end of each guard hair is tapered. Since the free end portions of the guard hair in the genuine fur are generally tapered, the great contribution to the technology in the field of producing the artificial furs taught by the above mentioned U.S. patent must be recognized.

However, in the artificial fur disclosed by the above mentioned U.S. patent, a problem still remains which must be solved in order to create a good quality artificial fur. This problem is mainly due to the characteristic feature of the pile fibers which do not satisfy the qualities required in the combination of the guard hair with the underfur. That is, the quality of flutter of the guard hair is insufficient as compared with that of genuine fur. In addition to the above mentioned inferiority of this feature of artificial fur, the hand of this artificial fur is coarse. Specifically, the hand of the guard hair is rather coarse, so that a fur-like soft and elegant hand is not achieved with this artificial fur. It has been found that the above mentioned problems are mainly due to a structural feature of the guard hair. The root portion of the guard hair fibers, which is locked in the ground construction of the artificial fur, is not thin.

We have invented a very unique artificial fur which has an excellent hand, excellent luster and special structural features, mainly due to the guard hair being like that of genuine furs, and the method of manufacturing which is disclosed in U.S. Pat. No. 4,415,611. This artificial fur has the following characteristic features regarding the construction thereof. That is, this artificial fur comprises a ground construction and numerous units of pile fibers projecting upward from the ground construction, and each unit of pile fibers is provided with a yarn-like bundle at a root portion. At least a main part of the above mentioned root portion is firmly locked in the ground construction and the fibers of each unit are opened up above the root portion, the pile fibers are made from fibrous materials and are provided with varied lengths thereof in a range from almost zero to a length almost identical to the maximum fiber length.

To produce the above mentioned unique artificial fur the following method was invented and disclosed in U.S. Pat. No. 4,415,611. This method comprises the following three steps: a first step of making a pile cloth consisting of a ground construction and a plurality of yarn-like pile units projected upward from the ground construction;

a second step of raising the pile to remove those fibers not firmly held in the ground construction while opening those fibers firmly held by the ground construction; and a third step of finishing the raised pile cloth product.

However, it has been determined that the artificial fur produced by the method of U.S. Pat. No. 4,415,611 has serious problems regarding the guard hair as well as the quantity of waste fibrous material made during the second step of the method which is a significant factor in manufacturing costs. Further, the manufacture of the pile cloth is often accompanied by cutting the fibrous material of the guard hair contained in the pile. Therefore, it is preferable to produce the intermediate pile cloth with pile having a pile length not shorter than the maximum length of the fibrous material forming the guard hair. Therefore, the greater the pile length of the intermediate pile cloth, the greater the number of free fibrous materials which are not firmly held by the ground construction. In other words, there is a great quantity of waste fibrous material created in the second step (raising operation) of the manufacturing method of U.S. Pat. No. 4,415,611. Such an increase in waste fibrous material by the removal of free fibrous material cannot be neglected in practice.

In this specification, the term "pile cloth" means (1) a pile fabric provided with a woven or knitted ground construction with or without a backing substance and a plurality of pile fibers projecting upward from the ground construction or (2) a pile cloth provided with a non-woven ground construction with or without a backing substance and a plurality of pile fibers projecting upward from the ground construction.

SUMMARY OF THE INVENTION

An object of the present invention is to provide an improved yarn for manufacturing the artificial fur having characteristics similar to high quality genuine furs in structure, appearance, and hand.

This object of the present invention can be attained by the following basic idea for creating pile fibers projecting upward from the ground construction, the manufacture of the pile cloth for the artificial fur from an intermediate pile cloth such as double velvet weave construction, or such as a tufted pile cloth utilizing a non-woven cloth as the ground construction thereof. The continuity of each pile of the intermediate cloth is broken without breaking or cutting at least some of the fibrous material forming the guard hair of the artificial fur and contained in the pile. It is essential that the breaking of continuity of each pile be carried out so as to satisfy the above mentioned conditions. Therefore, it may be understood that, the method for manufacturing the artificial fur according to the present invention is characterized by the application of the processing based upon the above mentioned basic idea.

DETAILED DESCRIPTION OF THE INVENTION

For ease of understanding the present invention, the principle of the present invention is first explained in detail, in reference to the drawings.

The novel yarn for manufacturing artificial fur according to the present invention is characterized by the basic idea of using the yarn in a continuous form to make a pile, but structuring the yarn for subsequently breaking the continuity of each pile contained in the intermediate pile cloth, such as a fabric having a double velvet weave construction or a tufted pile cloth utilizing a woven or non-woven cloth, for example.

In the present invention, the following principles for carrying out the process of breaking the continuity of the yarn comprising each pile contained in the intermediate cloth is introduced in reference to the following basic idea which is hereinafter explained in detail.

Figure 1:
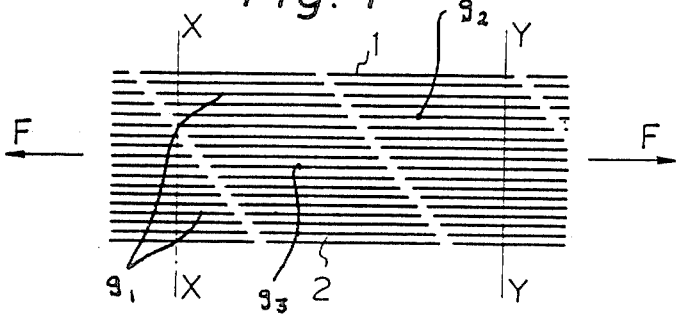
FIG. 1 is a schematic side view of an ideal model of a bundle of fibers wherein fibers are arranged uniformly.
Figure 2:
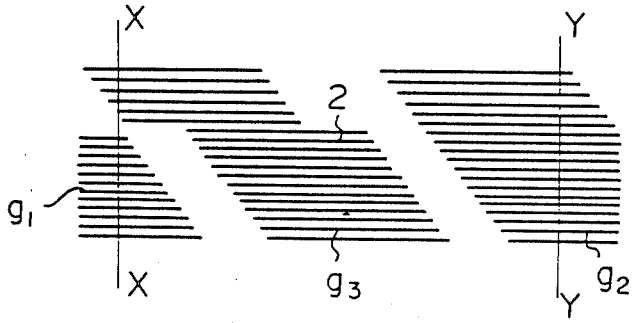
FIG. 2 is a schematic side view of the bundle of fibers shown in FIG. 1 in the condition of separating into two portions along the lengthwise direction thereof.

FIG. 1 indicates a typical model of the fiber arrangement of a theoretical bundle 1 of fibers 2, compacted in a yarn form by a means not shown. Fibers 2 are uniformly arranged parallel to the longitudinal axis of the bundle of fibers, and this bundle 1 is held by a pair of grips (not shown) at the XX and YY positions so that the distance between the two gripped positions XX and YY is larger than the staple length of the component fibers 2. The bundle 1 is pulled apart by the grips along the longitudinal direction, therefore tension F along the longitudinal direction of the bundle 1 is created. Under such condition, as shown in FIG. 2, three groups of fibers 2 are created. These are a first group $g_1$, wherein fibers 2 are held by the grip represented by the line XX, a second group $g_2$ wherein fibers 2 are held by the grip represented by the line YY, and a third group $g_3$ wherein fibers 2 are free from either of the grips. In other words, the application of tension F to the bundle 1 of fibers 2, as shown in FIG. 2, breaks the continuity of the bundle 1.

As described in U.S. Pat. No. 4,415,611, it is known that an artificial fur can be made from an intermediate pile cloth such as a pile fabric having a construction of double velvet weave or a pile cloth provided with a plurality of looped piles projected upward from a non-woven ground construction.

When using the intermediate pile cloth having a construction of double velvet weave, each of the plurality of piles (hereinafter referred to as "connecting pile") connecting two ground constructions must be separated into two parts such that one is held by one ground construction and the other is held by the other ground construction thereby creating two pile cloths. Now it is assumed that the yarn for the pile is composed of a plurality of fibers uniformly arranged in parallel to the longitudinal axis of a bundle before providing twist. To simplify the following explanation, the existence of twist is excluded from the present explanation.

Figure 3:
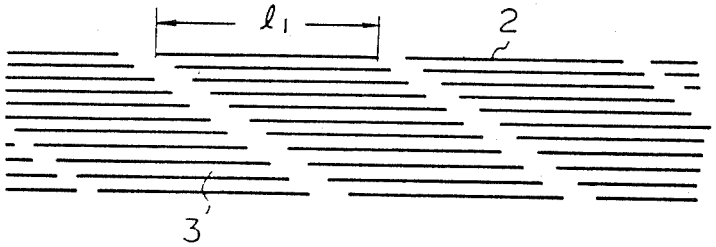
FIG. 3 is a schematic side view of a pile yarn for making an intermediate pile cloth indicating a theoretical fiber arrangement therein.
Figure 4A:
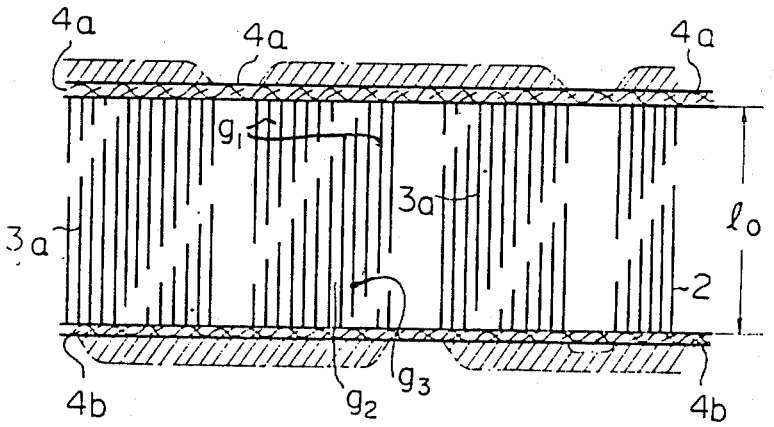
FIG. 4A is a schematic cross sectional view of a double velvet weave construction utilizing the yarn shown in FIG. 3.
Figure 4B:
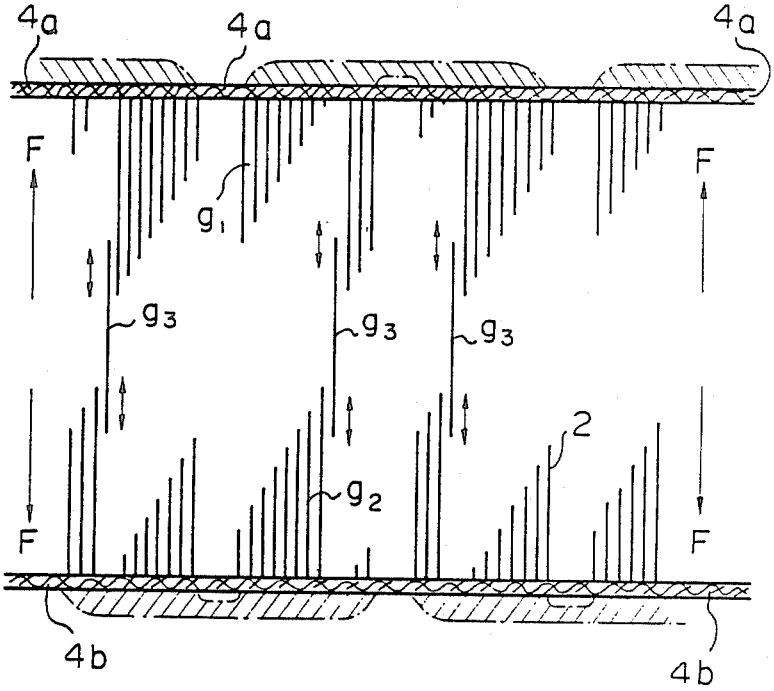
FIG. 4B is a schematic cross sectional view of the double velvet weave construction shown in FIG. 4A, in the preferable condition of breaking the continuity of the pile which connects the two ground constructions.

The yarn 3 is represented as the bundle of the component fibers 2 in FIG. 3. In this drawing, each fiber 2 has an identical length $l_1$. If such material yarn 3 is used for the pile 3*a* of an intermediate pile cloth having double velvet weave construction provided with two ground constructions 4*a* and 4*b*, as shown in FIGS. 4A and 4B, and the distance $l_0$ between the inside surfaces of the two ground constructions 4*a* and 4*b* is larger than the length $l_1$ of the fiber 2, the application of tension F to the pile 3*a* as in FIG. 1, a phenomenon similar to that shown in FIG. 2 is created. That is, as shown in FIG. 4B, the application of tension will separate the first group $g_1$ of fibers 2 held by ground construction 4*a* and the second group $g_2$ held by the ground construction 4*b* and will free the third group $g_3$ from both ground constructions 4*a* and 4*b*. When using intermediate pile provided with a plurality of looped piles projected upward from a woven, knitted or non-woven ground construction, each looped pile must be separated into two parts such that each part is held by the ground construction.

Figure 5:
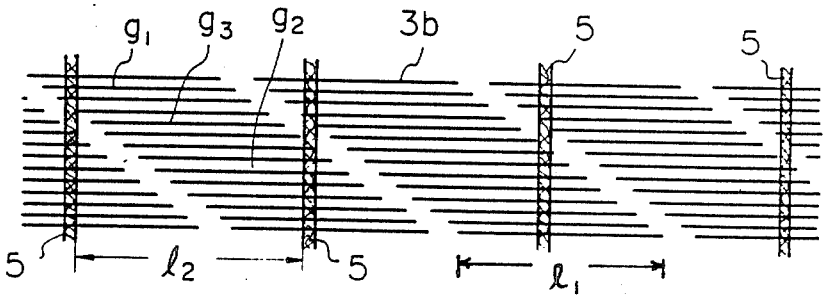
FIG. 5 is a schematic flat projection view of an intermediate pile cloth wherein a plurality of looped piles are proJected upward from a ground construction.

In intermediate pile cloth produced from yarn according to this invention, as shown in FIG. 5, the length $l_2$ of the looped pile 3*b* projected upward from the ground construction 5 is preferably longer than the fiber length $l_1$ of the fiber 2. The application of tension to pull apart the looped pile 3*b* made by the yarn 3 will create a phenomenon similar to that depicted in FIGS. 2 and 4B. It will separate the first group $g_1$ of the fibers 2 held by the ground construction 5 from the second group $g_2$ of the fibers 2 held by the ground construction 5 and will free the third group $g_3$ of fibers 2 not held by the ground construction 5.

The above mentioned phenomenon of separating the continuity of the pile 3*a* and 3*b* is hereinafter referred to as "sliding separation" or "longitudinal sliding separation". The application of the sliding separation of the component fibers of the pile, particularly the fibers forming the guard hair of the artificial fur is one of the most important factors in the yarn according to the present invention. Application of the above mentioned basic technical idea of "sliding separation" to break the continuity of each pile of the intermediate pile cloth significantly reduces the possibility of cutting the tips of the fibers forming the guard hairs or the possibility of creating large amounts of fibers like the third group $g_3$ so that it allows considerable improvement in the quality of the final product, artificial fur. It is one of the most important results of the application of the present invention.

There are three kinds of yarn for forming the pile of the intermediate pile cloth. The first yarn is a spun yarn with very low twist. This yarn consists of a first group of fibrous material which will form guard hair and a second group of fibrous material which will form underfur of the artificial fur produced. To create a yarn having a similar fiber arrangement to the theoretical bundle of fibers shown in FIG. 1, it is preferable to reduce the number of twists imparted to the yarn. Reduction of the twist number below a certain limit, however, so weakens the yarn that the operation of producing the intermediate pile cloth becomes practically impossible. To overcome this, one can use a third fibrous component having a length longer than a certain length, such as that of the first group of fibers and blend it with the other two groups of fibers so as to create a modified yarn for the pile. In this case, before applying the sliding separation process, it is necessary to break the continuity of the pile by cutting or removing said third fibrous component. For the third fibrous component one can use a fiber soluble in a certain chemical agent or being so weak that it is easily cut without any cutting action to another fibrous component. The above mentioned yarn is hereinafter referred to as first yarns.

The second yarn is a double yarn formed by a first component yarn and a second component yarn. The first component yarn is composed of a first group of fibrous material to form the guard hairs and a second group of fibrous material to form the underfur of the artificial fur. In this first component yarn, the above mentioned two fibrous materials are blended uniformly and are arranged parallel to the longitudinal axis thereof. To impart yarn strength, this first component yarn is twisted. The second component yarn is made of a third fibrous component. This second component yarn may be a thin multifilament yarn or a thin spun yarn made from fibers easily removable by chemical or physical treatment, In this case, it is very important to substantially eliminate the twist of the first component yarn when these two component yarns are twisted.

As a third yarn, there must be a yarn blended or mixed with said first group second group of fibrous materials and several parts of said fibrous materials being adhered to each other with an adhesive which is easily dissolved by solvent which does not dissolve said fibrous materials and as another special type of this third yarn, the yarn may consist of multifilament yarns disclosed in U.S. Pat. No. 4,415,611 consisting of a plurality of individual filaments, each having an island-in-sea fiber construction, which can be used to form the first group of fibrous material which form the guard hairs of the artificial fur produced according to the present invention. In this case, this multifilament yarn is twisted with another multifilament yarn comprising a second group of fibrous material to form the underfur of artificial fur. It is preferable to use this yarn constructed with the second component yarn surrounding the first component yarn. It is preferable to remove the sea component of this island-in-sea fiber by a known chemical treatment before the sliding separation of the pile.

The basic idea is to utilize the phenomenon of sliding separation to break the continuity of the pile of the intermediate pile cloth in the present invention. Therefore, in all cases utilizing the above mentioned yarns to form pile in the intermediate pile cloth, it is essential to first change the condition of the yarn to the ideal constructions shown in FIG. 3 as much as possible. This enables smooth and effective sliding separation to break the continuity of the piles.

Figure 6A:
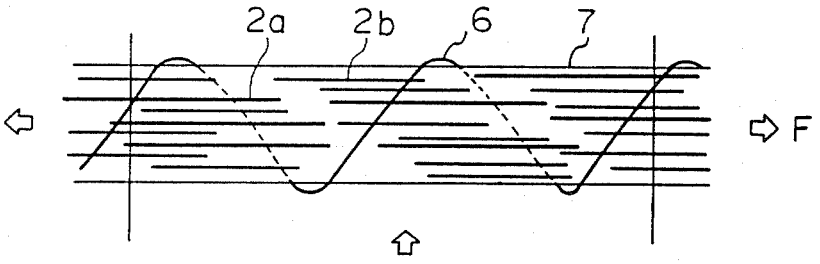
FIG. 6A is a schematic side view of a yarn according to this invention, consisting of three fibrous materials wherein the third spirally surrounds the core portion consisting of the other two, for producing a pile cloth.
Figure 6B:
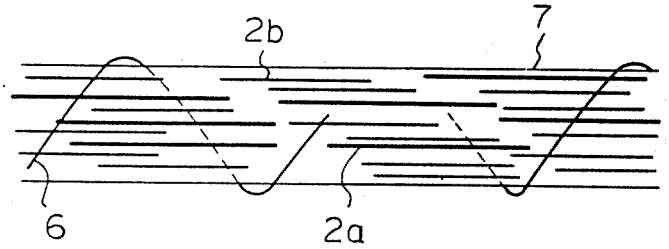
FIG. 6B is a schematic side view of the pile yarn shown in FIG. 6A which indicates the breaking of the continuity of the third fibrous material during the process for manufacturing artificial fur according to the present invention.

For ease of understanding, this technical idea is explained in more detail with reference to the embodiment shown in FIGS. 6A and 6B, which is an example utilizing the second yarn. Each pile 2 in the intermediate pile cloth is formed by a bundle of fibers consisting of a first group of fibrous material *2a*, a second group of fibrous material *2b*, and a third fibrous material 6 spirally surrounding the above-mentioned bundle of fibrous materials as shown in FIG. 6A. The first group of fibrous material *2a* is longer and thicker than the second group of fibrous material *2b* so that the first group *2a* will form the guard hairs, and the second group *2b* will form the underfur of the final artificial fur. These two groups of fibrous materials *2a* and *2b* are uniformly mixed in the yarn 7 and are arranged in parallel along the yarn axis. The intermediate pile cloth is constructed with a double-velvet weave construction, and yarn 7 forms a connecting pile between the two ground constructions when the double-velvet fabric is made. Therefore, the application of sliding separation necessitates first cutting, breaking or removing the third fibrous material 6 before creating the sliding separation. Research conducted by the present inventors has shown that the third fibrous material 6 can be easily cut by applying tension to each connecting pile of the double velvet fabric. One method to cut the third fibrous component 6 is to apply a pushing force tc the middle of each connecting pile made by the yarn 7 in a direction perpendicular to this portion. Another method is to apply a force to pull apart the two ground constructions. FIG. 6B shows the cutting of the third fibrous component 6.

If the third fibrous material 6 can be dissolved by a certain chemical agent, including water, such chemical treatment can be applied to remove the fibrous component 6 before sliding separation.

Experiments have confirmed that the third fibrous material can be effectively cut by vibrating action or a pushing action of a member without a knife edge, instead of the cutting knife normally used for creating pile fabric from the double velvet woven or knitted fabric.

In the case of producing an intermediate pile cloth to produce the artificial fur by utilizing an intermediate pile cloth provided with numerous looped piles, the abovementioned method of dissolving the third fibrous material can be effectively applied.

According to our research work, it has been confirmed that, if only the third fibrous material 6 is first cut by using a sharp knife, in spite of some possibility of cutting some fibrous material contained in the pile, such utilization of the sharp knife is very useful in creating sliding separation.

This modified technical idea is very useful when using the above-mentioned second yarn. Since the yarn is provided with twists, even if the number of twists is very low, the component fibers of the yarn mutually interfere with each other. Therefore, it is practical to first cut a part of each pile of the intermediate pile cloth, because when this part is cut, the tension applied to the pile concentrates on the remaining fibers in this portion and the above-mentioned mutual interference is simultaneously broken so that the above sliding separation is achieved more effectively. When using a first group of fibrous material much longer and thicker than the second group of fibrous material and having tapered thin free ends, experimentation has confirmed that the above-mentioned sliding separation is carried out very smoothly and effectively while reducing the possibility of cutting this first group of fibrous material. This is the case even when using a separating member having a sharp knife edge, to provide the pushing force or combination pushing force and shearing force to the piles. In experimental tests, when the pile projecting upward from the ground construction was carefully observed, it was found that the tapered tips of the guard hair of the artificial fur were not seriously damaged by the sliding separation, even when using a separating member having a sharp knife edge. It is understood that the principal reason that the tapered tips of the first group of fibrous material were not substantially damaged is mainly dependent upon the shape of this fibrous material. This allows for the avoidance of the action of the sharp edge of the separating member during sliding separation. As each connecting pile connecting the two ground constructions of the intermediate pile cloth or each looped pile projecting upward from a ground construction is partially cut by a separating member provided with a sharp knife edge, there is a possibility of cutting the first and second groups of fibrous material. Therefore, when the method of the present invention is applied, it is important to control the above-mentioned cutting of a part of the yarn so as to cut the first group of fibers as little as possible. This control can be achieved by using a specific separating member provided with a partially sharp knife edge.

Next, the improved method for manufacturing artificial fur according to the present invention is explained in more detail with reference to drawings indicating the preferred embodiments.

The embodiment using intermediate pile cloth having the double velvet weave construction is explained hereinafter.

Figure 9A:
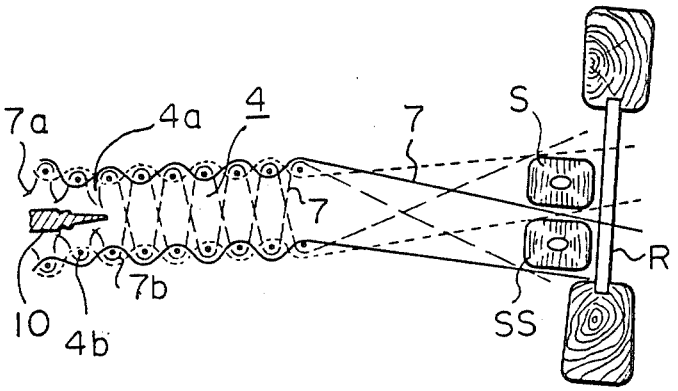
FIG. 9A is a schematic side view of a part of the apparatus for manufacturing intermediate pile cloth having a double velvet weave construction.
Figure 9D:
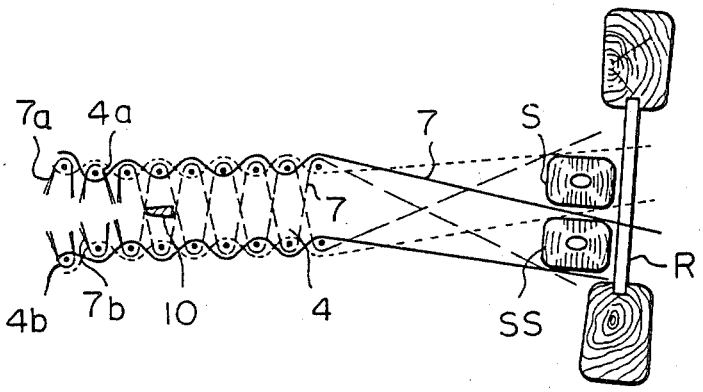
FIG. 9D is a schematic side view of a part of another apparatus for manufacturing intermediate pile cloth having a double velvet construction which is a modification of the apparatus shown in FIG. 9A.
Figure 9B:
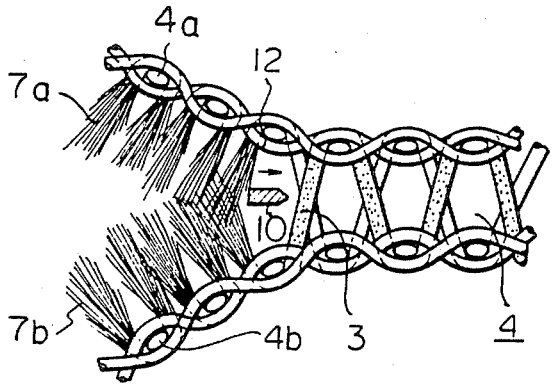
FIG. 9B is an enlarged side view of a part of the apparatus shown in FIG. 9A.
Figure 9C:
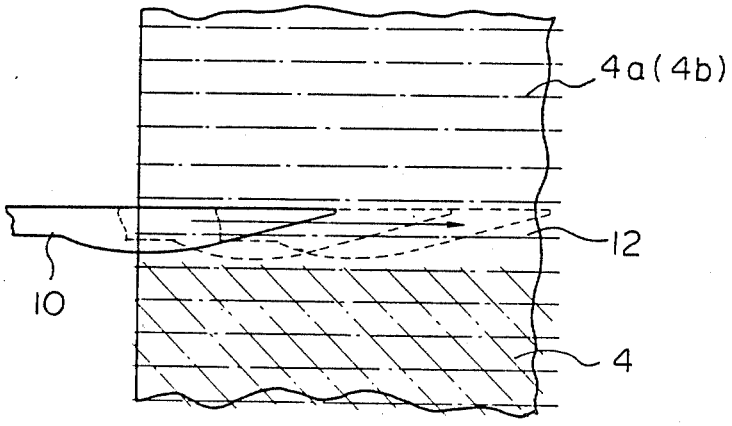
FIG. 9C is a schematic plan view of a part of the apparatus shown in FIG. 9A.
Figure 10A:
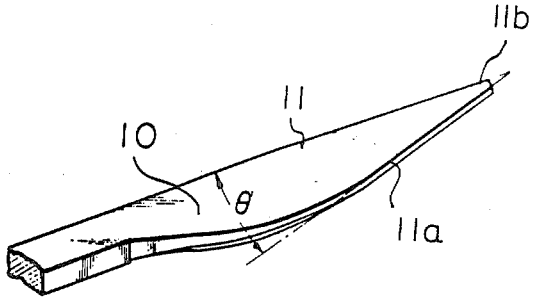
FIG. 10A is a schematic perspective view of a separating member utilized for the apparatus shown in FIG. 9A.

FIG. 9A shows a schematic side view of an apparatus for double fabric plush weaving, wherein S and SS represent two shuttles respectively and R represents a reed of the weaving loom. After the double velvet fabric is created, the continuity of each connecting pile made by the yarn 7, connecting the two ground construction weaves 4*a* and 4*b*, is broken by applying the pushing force of a separating member 10 at an intermediate stage just before the displacement of the connecting pile. As shown in FIGS. 9A and 9B, the separating member 10 is positioned at the point of separation of the front end of the double velvet fabric 4 into two pile weave constructions 4*a* and 4*b* so as to separate the connecting pile into two parts. One of the typical embodiments of the separating member 10 is shown in FIG. 10A. The separating member 10 is provided with a knife portion 11 with a working edge 11*a* and a sharpened tip portion 11*b*.

In this embodiment, the working edge 11*a* is not so sharp. This separating member 10 is capable of reciprocal displacement along the weft yarn of the double velvet fabric 4, in such a manner that the separating member 10 is displaced into the double velvet fabric 4. The double velvet fabric is displaced toward the member 10 as the woven fabric produced by the weaving loom is taken up. The working edge 11*a* faces an alignment of the connecting pile located at the front end of the double velvet fabric 4. The pushing force of the member 10 is mainly applied to the alignment of the connecting pile located at the front end of the double velvet fabric 4. Therefore, this pushing force creates tension in each connecting pile located at the front end of the double velvet fabric 4.

The shape and displacement speed of the separating member 10 is determined so as to create the tension which is sufficiently strong to break the continuity of each connecting pile under the above-mentioned principle. Therefore, when the separating member 10 is displaced into the space in front of the front end of the double velvet fabric 4, each connecting pile made by the yarn 7 at the front end of the double velvet fabric 4 is divided into two portions 4*a* and 4*b* as shown in FIGS. 9A and 9B.

In this process, when the yarn has a construction like the yarn shown in FIG. 6A, the pushing force first breaks the third fibrous material spirally surrounding the core portion of the yarn and then separates the fibers forming the core portion of each pile into two groups 4*a* and 4*b* as shown in FIGS. 9A and 9B, wherein the fiber group 7*a* is firmly held by the ground construction 4*a*, while the fiber group 7*b* (FIG. 9*b*) is firmly held by the other ground construction 4*b*. Fibers not to be held by either ground construction are held by one of the groups of fibers 7*a* or 7*b* in an easily separable condition or are removed from the working position of the separating member 10.

Experimentation has confirmed that the larger the distance between the inside surfaces of the two ground constructions of intermediate pile fabric 4 having a double velvet weave construction, the greater the quantity of wasted fibrous material arising from the above mentioned free fibers, that is, those not too firmly held by either ground construction. In other words, the amount of wasted fibrous material can be effectively reduced by choosing a distance not shorter than the length of the first group of fibrous material forming the guard hair of the artificial fur.

In the above-mentioned embodiment, the separating member 10 applies its pushing force from the outside of the double velvet fabric 4. Experiments by the present inventors, however, showed similar results if the separating member 10 applies its pushing force to the connecting pile from inside of the double velvet fabric 4 as shown in FIG. 9D.

According to our experimental tests, it was confirmed that the taper angle $\theta$ of the working portion of the separating member 10 is preferably in a range between 5° and 45° and that the length of the tapered working edge 11*a* is preferably in a range between 5 mm and 200 mm.

In the research, it was confirmed that if the two pile fabrics having the ground constructions respectively are pulled apart, the additional tension is applied to the connecting pile made by the yarn 7 at the front end of the double velvet fabric 4 beside the tension created by the action of the separating member 10, and thereby more effectively breaks the continuity of the connecting pile.

If the above-mentioned third fibrous material spirally surrounding the core portion of the yarn 7 is weak enough to break with the additional tension created by pulling apart the two ground constructions, one can omit the use of the separating member 10. If the third fibrous material is soluble in a certain chemical agent, one can treat the material pile cloth with this chemical agent, and omit the use of the separating member 10. Pulling apart the two ground constructions would be sufficient to create two pile fabrics.

As previously mentioned, one can use a yarn having a configuration similar to conventional spun yarns, if the length, thickness and other characteristics of the first group of fibrous material, forming the guard hair of the artificial fur, are quite different from those of the second group of fiber material, forming the underfur of the artificial fur. However, it is preferable to apply a modified method wherein a combination of a pushing force and a shearing force is utilized so as to practically carry out the process for manufacturing the artificial fur according to the present invention. In such cases, it is also preferable to first cut part of each pile which connects the two ground constructions of the double velvet fabric; then the remaining portion of each connecting pile is separated by the pushing force of the separating member 10, as in the first embodiment.

Figure 10B:
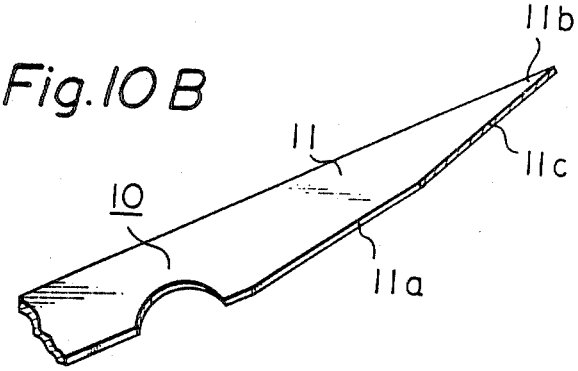
FIGS. 10B and 10C are schematic perspective views of modifications of the separating member shown in FIG. 10A.

Experimentation has shown that one can effectively use a separating member 10 having a similar shape to the member 10 shown in FIG. 10B, wherein a sharp knife edge 11*c* is formed at the free end. When using this separating member 10, the sharp knife edge portion 11*c* works to cut part of the outside of each connecting pile, while the remaining edge works to create sliding separation of each pile by a pushing force of the remaining edge of the member 10.

Figure 10C:
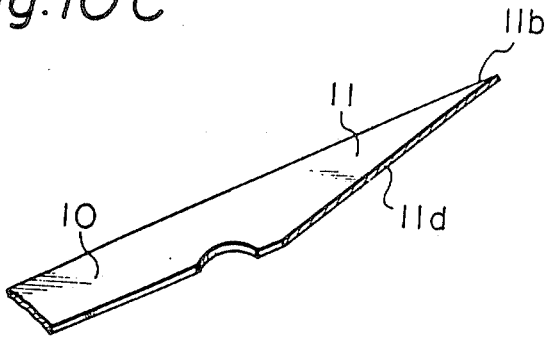

FIG. 10C shows another separating member 10 which can be used to produce artificial fur from yarn according to the present invention. The separating member 10 allows at least some of the first group of fibrous material to escape from cutting, but cuts all of the second group of fibrous material during the breaking of the continuity of the connecting pile made by the yarn 3. As shown in FIG. 10C, this separating member 10 is provided with a sharp knife edge 11*d*. For example, if such yarn, composed of a spun yarn or a fibrous bundle formed by the first group of fibrous material and a multifilament yarn which will be cut to form the underfur of the artificial fur which were twisted with the other to substantially eliminate the twist of the spun yarn if the spun yarn is used or were spirally or parallely wrapping around the other, is used to form the pile of the intermediate pile cloth of double velvet weave construction, and wherein the thickness of the first group of fibrous material is remarkably thicker than the thickness of an individual filament of the multifilament yarn, and the mechanical properties of the former are much better than the latter, there is a strong possibility that the latter one (multifilament yarn) will be cut by the sharp knife edge 11*d* of the member 10 while most of the fibers of the former are capable of escaping from the cutting action of the knife edge 11*d* of the member 10. The sliding separation of the first group of fibrous material is created when pushing and shearing forces of the separating member 10 are applied to the connecting pile at the front end of the double velvet fabric 4 which is the intermediate pile cloth.

In U.S. Pat. No. 4,415,611, the preferable construction of the artificial fur was explained. From this explanation, it is understood that the ground construction of the artificial fur must be well covered by underfur and the underfur must be well protected by the guard hair. In addition, the ground construction must have qualities such as stiffness and weight similar to those of the skin of genuine fur. It is also necessary to consider the color of the raw material for the pile fibers and the ground construction of the artificial fur. Consequently, one must take great care in designing the artificial fur to choose the optimal raw material for the pile fibers and the ground construction, the optimal construction of the pile yarn and intermediate pile cloth, as well as the optimal method of inducing sliding separation to break the continuity of the pile.

The preferred fibrous materials, the yarns, the intermediate pile cloths, for producing the artificial fur according to the present invention are hereinafter explained in detail.

For ease of understanding, the typical construction of the artificial fur according to the present invention is hereinafter explained before explaining the results obtained by the experimental tests.

Figure 11A:
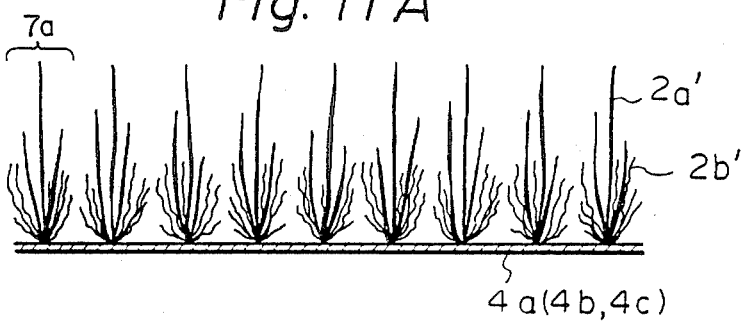
FIG. 11A is a schematic side view of a typical artificial fur made of yarn according to the present invention.

As shown in FIG. 11A, the typical artificial fur produced according to the present invention comprises a ground construction 4*a* (4*b*, 4*c*) and a plurality of units of pile fibers 7*a* projecting upward from this ground construction. Each unit of pile fibers 7*a* is provided with a yarn-like bundle at its root portion, at least a main part of this root portion is firmly locked in the ground construction. The pile fibers 2*a*′ and 2*b*′ each unit 7*a* are separated from each other from above its root portion. The pile fibers 2*a*′ and 2*b*′ are made from fibrous materials and are provided with varied lengths ranging from almost zero to almost the maximum length of the fibrous materials. In this artificial fur, the above-mentioned pile fibers partly comprise relatively short and fine fibers 2*b*′ (second group of fibers), which constitute the underfur, and partly comprise relatively large diameter straight fibers 2*a*′ (first group of fibers) projecting from the underfur as guard hair. The guard hairs.

Figure 11B:
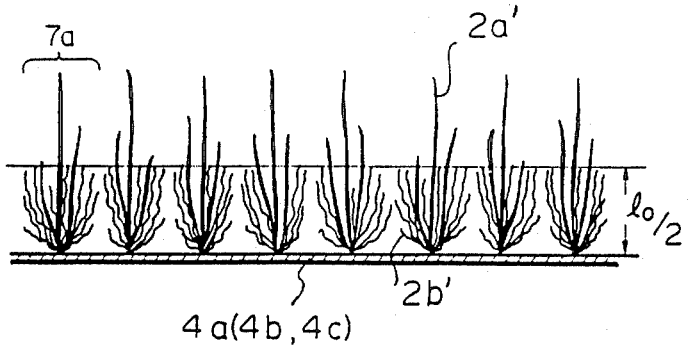
FIG. 11B is a schematic side view of a modified artificial fur made of yarn according to the present invention.

On the other hand FIG. 11B shoes another artificial fur produced according to the present invention by using multifilaments as the second group of fibrous material and by cutting them during said sliding separation.

Figure 12A:
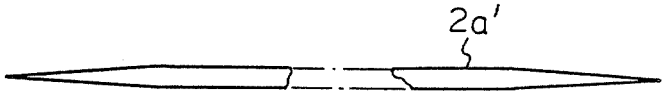
FIGS. 12A and 12B are schematic side views of a fibrous material of the yarn of this invention for forming the guard hair of the artificial fur.
Figure 12B:
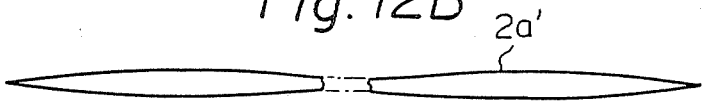

The preferred material for the first group of fibrous material 2*a*′ is one much thicker and longer than the second group of fibrous material 2*b*′ and has two tapered free ends as shown in FIG. 12A. This is required because the first group of fibrous material 2*a*′ is randomly blended with the second group of fibrous material 2*b* when the material yarn is produced. Experiments by the present inventors have shown that one can also use a modification of the first group of fibrous material 2*a*′ shown in FIG. 12B for the first group of fibers in the present invention. When each fiber of the first group of fibrous material 2*a*′ has the above-mentioned particular shape characterized by the tapered free ends, it is the inventors' understanding that the tapered free ends of the fibrous material easily escape from the cutting action of the sharp knife edge of the separating member while easily escaping the interference from fibrous material moving in the opposite direction during the sliding separation.

The preferred material for the second group of fibrous material includes various types. For example, staple fiber may be blended with a first group of fibrous material when the spun yarn is produced, or a multifilament yarn formed by a plurality of thin individual filaments may be used. In the latter case, the individual filaments are cut by a separating member having a sharp knife edge which creates sliding separation so as to break the continuity of the pile of the material pile cloth.

For the fibrous material, one can use fibrous material having triangular, square, irregular, elliptical, or other type cross sections.

In addition to the above-mentioned conditions for the fibrous material to be used in manufacturing the artificial fur according to the present invention, it is also important to carefully select the optimal relation between the length and thickness of the first group and the second group, as well as the mixing ratio thereof in the yarn forming the pile of the intermediate pile cloth. When using intermediate pile cloth having two ground constructions connected by connecting pile projected from the respective ground constructions, it is preferable to satisfy such conditions that the length ratio (length of the first group of fibrous material)/(length of the second group of fibrous material) is in a range between 1.0 and 5.0. If the first length-to-second length ratio is below 1.0, or above 5.0, it is quite difficult to produce a pile cloth having good quality. For the mixing ratio of the two materials in the pile yarn, it is preferable that the blend ratio of the first group of fibrous material to the second group of fibrous material be in a range between 15 and 70% by weight.

It has also been confirmed that a distinctive difference between the lengths of the two groups of fibrous material results in an excellent appearance in the final product. However according to the research conducted by the present inventors, it is desirable that the second group of fibrous material has its fiber length in a range between $\frac{1}{2}$ and $\frac{1}{3}$ of the length of the first group of fibrous material. If a conventional spun yarn is used as a pile yarn, since a low twist thereof is preferable to smoothly carry out the breaking of the continuity of the piles formed in the intermediate cloth, it is further preferable to use such second group of fibrous material having sufficient crimp so as to assist in the stable formation of yarn.

Regarding the relation between the length of pile or loop pile of the intermediate pile cloth and the length of the first group of fibrous material, it is understood that the length of the pile is defined by the length of the first group of fibrous material in such a way that the length of the former is not shorter than the latter. In practice, one chooses for the first group of fibrous material, a length in a range between 10 and 75 mm, preferably between 15 and 40 mm, and most preferably between 15 and 30 mm.

Experimentation on the thickness of the fibrous materials, has shown that the preferred ratio of the average thickness of the first group of fibrous material to the second group of fibrous material is in the range between 10 and 100. For example, one would choose a thickness of the fibrous material of the second group in a range between 1 denier and several deniers, while the thickness of the first fibrous material is in a range between scores and 100 deniers.

Regarding the mixing ratio in relation to the thickness of the fibrous materials, a particular experimental test was conducted. Example 1, which will be explained later, is involved in this experimental test, with the following conclusion. To produce the artificial fur having the desired quality, it is necessary to carefully select the fibrous material regarding the above-mentioned mixing ratio in relation to the thickness of the fibrous materials so as to satisfy the condition defined by the following equations (1) and (2).

$$15 \leqq D \leqq 80 \quad (1)$$

$$\frac{50D}{50+D} \leqq R \leqq \frac{450}{D} + 55 \quad (2)$$

where

D designates the thickness of the thickest portion of the first fibrous material in denier, R designates the mixing ratio of the first fibrous material in the yarn in weight % and R is calculated by the following equation $$R = \frac{A}{A+B} \times 100$$

wherein

A designates the weight of the first group of fibrous material contained in a unit weight of the yarn, B designates the weight of the second group of fibrous material contained in a unit weight of the material yarn.

Figure 14:
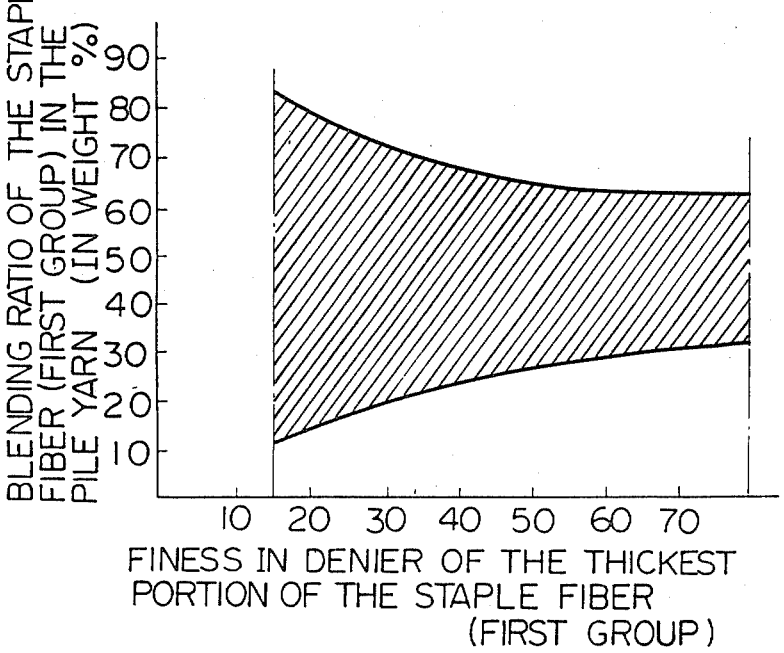
FIG. 14 is a diagram indicating the relation between the blending ratio of the staple fiber (first group) in the pile (in weight %) and fineness in denier of the thickest portion of the staple fiber (first group) regarding a preferable embodiment to produce artificial fur according to the present invention.

As mentioned above, it is necessary to choose the first group of fibrous material so as to satisfy the condition defined by the equation (1). If the thickness of the thickest portion of the first group of fibrous material is less than 15 deniers, the resilience of the guard hair of the artificial fur is so weak that the hand of the artificial fur becomes deficient. If the above-mentioned thickness is thicker than 80 denier, the hand of the artificial fur becomes coarse so that the quality of the final product is poor. To create an excellent quality of artificial fur, it is also necessary to satisfy the condition defined by equation (2). The relation defined by the two equations (1) and (2) is represented by a diagram shown in FIG. 14. If R is below 50D/(50+D), the guard hairs do not stand out distinctively in the artificial fur and its hand is incorrect. On the other hand, if R is above (450/D) +55, the guard hair stands out distinctively in the artificial fur, producing an appearance in the artificial fur which is rich, but the guard hair becomes so stiff that the flutter characteristics are poor and the mix of the guard hair with the underfur is wrong. Such artificial fur has a hand much coarser than that of genuine fur.

As to the above-mentioned fibrous material, known artificial fiber materials such as polyester, polyamide, acrylic, polyolefin, protein fibers, rayon and acetate and natural fiber materials such as wool, cotton, flax, silk, etc. can be selectively utilized.

As already briefly explained, various yarns can be utilized to form the pile of the intermediate pile cloths. Examples of such pile forming yarns include: conventional spun yarns; composite yarns having an island-in-sea hypolymer fiber wherein the island component becomes the guard hair of the final product; yarn composed of doubled component yarns; twisted yarns such as a conventional twisted yarn composed of a pair of component spun yarns, or composed of a conventional spun yarn spirally surrounded by a component filament yarn, or composed of a pair of multifilament component yarns. However, the basic technical idea of this invention is the sliding separation of at least the first group of fibrous material so as to break the continuity of the pile of the intermediate pile cloth. Therefore, it is preferable that the yarns be modified so as to be as similar as possible to the ideal construction shown in FIG. 1. For example, if a spun yarn is used, the twist number must be reduced to as low as possible. Therefore, it is preferable to use fibrous material having a comparatively longer-length than is used in the conventional spun yarns. It is also preferable to use a second group of fibrous material having sufficient crimp so as to contribute to the increase in the strength of the yarn. If the fiber length of the first and second fiber groups is longer than half of the length $l_0$ of the connecting pile which connects two ground constructions of an intermediate pile cloth having a double velvet weave construction, or is longer than ½ of the length of the looped pile of an intermediate pile cloth, application of a separating member to break the continuity of the pile enables the creation of artificial fur of the construction shown in FIG. 11A or 11B. Research by the present inventors has shown that such spun yarn composed of a first group of fibers for the guard hair, a second group of fibers for the underfur and a third group of fibrous material to provide sufficient yarn strength for the weaving operation, can be effectively used if the third group of fibrous material can be easily removed from this yarn. For example, if the third group of fibrous material is a fiber of polyvinyl alcohol resin which is soluble in water, this third fiber component can be easily removed from the yarn by a known wet processing. Removal of such third component fibers from the yarn significantly loosens the construction of the yarn is the intermediate pile cloth, resulting in the necessary condition for the manufacturing method of the present invention.

When a blended spun yarn having a conventional construction or a blended fiber bundle consisted of said the first and the second fiber group is used, it is also possible to treat this yarn with an agent which can be easily removed therefrom, so as to fix the yarn construction. For example, a water-soluble polyvinyl alcohol resin may be used to fix the yarn construction. After fixing the yarn construction using this agent, the yarn is untwisted if necessary. However, in this condition the fiber bundle or the spun yarn retains strength sufficient to carry out the weaving operation to produce the intermediate pile cloth, because the initial yarn strength is still maintained. This intermediate cloth is subjected to a chemical treatment to remove such a fixing agent. This significantly loosens the construction of the pile made by said fiber bundle or the spun yarn. Consequently, a preferred construction of the pile for breaking the continuity of the pile of the intermediate pile cloth is created.

The following fibrous materials are effective as a third group of fibrous material to be removed: polyester material which is soluble in alkaline solutions when the fibrous material for the guard hair is polyamide material; polyamide material which is soluble in pseudo-acids when the first group of fibrous material is polyester; acrylic fiber which is soluble in such solvent as dimethylformamide, dimethylsulfoxide, Rhodanic acid and Nitric acid; Styrene fiber which is soluble in trichlorine, Benzene and Xylene; polyester produced by copolymerization with Sodium-Sulfoisophthalate which is soluble in alkaline solution.

Figure 7A:
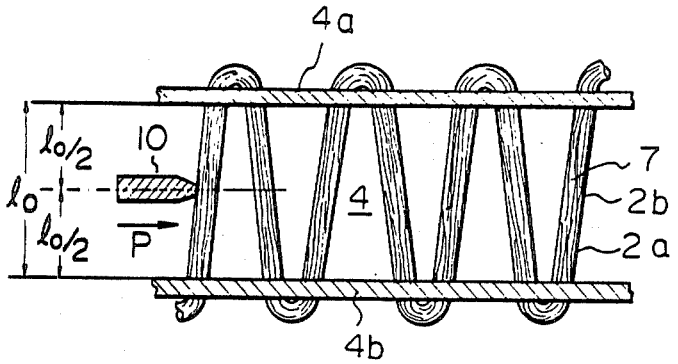
FIG. 7A is a schematic side view of an intermediate pile cloth using yarn of this invention having a double velvet weave construction with a separating member to act on about the middle of the connecting pile which connects the two ground constructions thereof, according to the present invention.
Figure 8A:
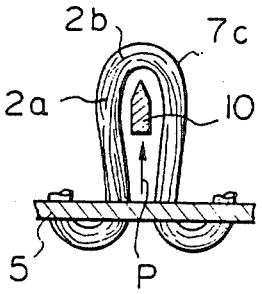
FIG. 8A is a schematic side view of an intermediate pile cloth using yarn of this invention provided with a plurality of loop piles with a separating member to act on about the middle of a loop pile thereof.
Figure 8B:
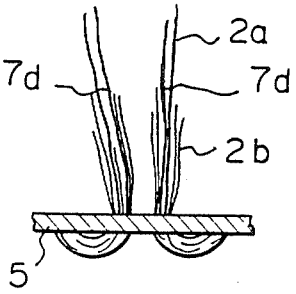
FIG. 8B is a schematic side view of a pile cloth after breaking the continuity of the loop pile shown in FIG. 8A.
Figure 13:
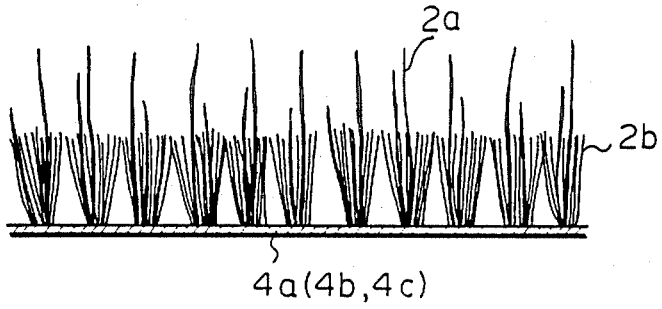
FIG. 13 is a schematic side view of another modified artificial fur containing yarn according to the present invention.

The same research has further shown that a double yarn consisting of a spun yarn formed only by a first group of fibrous material, twisted together with a multifilament yarn consisting of individual filaments to form the underfur of the artificial fur can be effectively used. The twist of the spun yarn is substantially eliminated when the above-mentioned two yarns are twisted. Since the individual filaments of the above-mentioned multifilament yarn become the underfur of the final product, care must be taken in choosing or designing the thickness and the length of the pile of the intermediate pile cloth when using such double yarn for the intermediate pile cloth as shown in FIGS. 7A and 8A. Care must also be taken in the application of a separating member having a sharp knife edge in such a manner so as to cut the filaments, while slide-separating the remaining fibrous materials of the pile. The working position for the separating member shown in those drawings, enables the creation of artificial fur having underfur formed by short pile fibers of identical length as shown in FIG. 13.

As to the typical type of yarn utilized to form pile in the intermediate pile cloth, a yarn consisting of a conventional spun yarn formed by a first group of fibrous material and a second group of fibrous material, with a multifilament yarn spirally surrounding the spun yarn is preferably utilized. In this case, the twist of this spun yarn is eliminated when the two yarns are twisted. If the multifilament yarn is cut or eliminated by chemical treatment before sliding separation of the connecting pile which connects the two ground constructions of the intermediate pile cloth, or the looped pile of the intermediate pile cloth, the most desirable condition of the yarn construction of pile of the intermediate pile cloth is created. Therefore, this type of yarn is the most preferable yarn.

The preferred intermediate pile cloth includes various materials such as double velvet fabric, double pile knitted fabric, loop pile fabric, loop pile knitted fabric, and loop pile tufted cloth provided with a ground construction of fabric woven, knitted or non-woven cloth.

To lock the pile fibers to the ground construction, it is preferable to apply backing treatment to the intermediate pile cloth before breaking the continuity of the pile of the intermediate pile cloth. A detailed explanation is omitted, as the operation is similar to that disclosed in U.S. Pat. No. 4,415,611. Besides the above-mentioned backing operation, particular consideration is paid to the design of the construction of the intermediate pile cloth. For example, when using pile cloth having a double velvet fabric construction, it is preferable to use the fast pile construction instead of the loose pile construction.

Research has shown that treatment of the intermediate pile cloth by an agent to ease the sliding of the fibrous material from the other material facilitates breaking the continuity of the pile by sliding separation without undesirable breaking of the first group of fibrous material. Such auxiliary finishing treatment by an agent such as an oiling agent can be applied.

The preferred ground construction of the intermediate pile cloth must also be considered as the properties thereof affect the qualities of the final artificial fur, such as the hand or drapability. For example, if good drapability is to be provided, it is desirable to use a thin ground construction or to increase the flexibility or stretchability of the ground construction. Imparting these particular properties to the ground construction facilitates the sewing of garments. To achieve these properties, one can use various yarns such as: yarn provided with fibrous material easily removed from the yarn by additional chemical treatment; yarn composed of splittable fibrous material; multifilament yarn formed by very fine individual filaments; and stretch yarn. In such a case, one generally applies a suitable auxiliary finishing treatment, such as a backing treatment to impart a leather-like quality to the ground construction.

For the preferred finishing of the pile cloth, the final process for manufacturing the artificial fur includes a raising operation carried out to raise the pile fibers projecting upward from the ground construction of the pile cloth while separating pile fibers of each unit thereof, and a brushing operation to remove the free fibers which are not firmly held by the ground construction of the pile cloth. However, because these finishing processes are disclosed in U.S. Pat. No. 4,415,611 the explanation thereof is omitted except for the following new matter. If fibrous material having fiber length almost identical to the length of the pile of the intermediate pile cloth is used, it is as the second group of fibrous material. It is preferable to break each such fibrous material of this second group by applying the scratching force created by a raising and/or brushing operation, so as to shorten the length of the second group of fibrous material projected upward from the ground construction. In such case, it is therefore preferable to use a thin and weak second group of fibrous material.

EXAMPLE 1

Fourteen kinds of blended spun yarn having a yarn count of 7–10 S (cotton counting system) were made by using four kinds of polybutylene terephthalate staple fibers (hereinafter referred to as PBT) having fiber deniers of 20*d*, 30*d*, 50*d* and 75*d* but having the same fiber length, 37 mm and having tapers on both ends as guard hair and using cotton fiber as underfur in the blending ratios described in Table 1. Then, eighteen kinds of cut pile fabrics were produced from velvet fabrics which were produced by using the above-mentioned blended spun yarns as pile yarn and 15 S/2 spun yarn composed of polyester staple fibers 1.5*d*×51 mm as both warp and weft yarns in ground construction of double velvet fabric and then separating those intermediate pile cloths into upper and lower pile fabrics by applying separating force to the intermediate fabric as shown in FIG. 7A. The length of the connecting pile was set at 39 mm in all examples.

After backing the pile fabrics thus produced with polyurethane 15% dimethylformamide solution, washing, extracting and drying were carried out on the eighteen kinds of pile fabrics.

Then, the pile of each fabric was completely opened from the top to the root portion thereof by a brushing treatment to eliminate the twist of the pile. At the same time, the cotton fibers and the PBT staple fibers having tapered portions on both ends, which were not held by the ground construction were also removed.

Figure 7B:
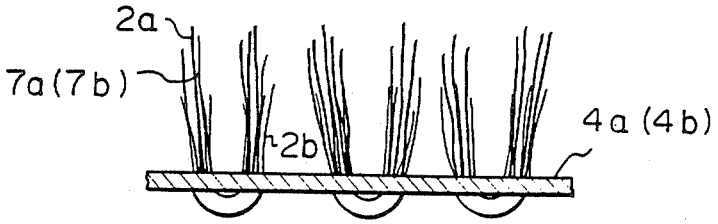
FIG. 7B is a schematic side view of a pile cloth produced from the intermediate pile cloth shown in FIG. 7A.

Consequently, eighteen kinds of artificial fur having a structure as shown in FIG. 7B were obtained.

The results of the evaluation of each fur like pile fabric are described in Table 1.

TABLE 1

| Thickness of fiber in denier | Blending ratio staple fiber as guard hair R (%) | Results of evaluation: Appearance of fabric | Hand of fabric | Pile characteristics of guard hair and underfur |
|---|---|---|---|---|
| 20 | 13(comparative) | x | Δ | ○ |
| | 22(this invention) | ○ | ○ | ○ |
| | 30(this invention) | ○ | ○ | ○ |
| | 60(this invention) | ○ ~ ◎ | ○ | ○ |
| 30 | 15(comparative) | x | Δ | ○ |
| | 24(this invention) | ○ | ○ | ○ |
| | 30(this invention) | ○ ~ ◎ | ○ | ○ |
| | 60(this invention) | ○ | ○ | ○ |
| | 75(comparative) | ○ | x~Δ | ○ |
| 50 | 23(comparative) | x | x | ○ |
| | 32(this invention) | ○ | ○ | ○ |
| | 45(this invention) | ◎ | ○ | ○ |
| | 60(this invention) | ◎ | ○ | ○ |
| | 65(comparative) | ○ ~ ◎ | x~Δ | x |
| 75 | 25(comparative) | x | x | ○ |
| | 33(this invention) | ○ | ○ | ○ |
| | 55(this invention) | ◎ | ○ | ○ |
| | 65(comparative) | ○ | x | x |

Note:
x designates Low grade,
Δ designates Ordinary grade
○ designates Good grade,
◎desginates Excellent grade

EXAMPLE 2

Two kinds of blended spun yarn were produced using different kinds of PBT staple fiber, having fiber deniers of 30*d* and 50*d*, respectively, and a fiber length of 37 mm but without tapers on both ends as guard hair, and using cotton fiber as underfur.

With 30*d* PBT staple, fiber, the blending ratio R was set at 30% and the yarn count was 10S. With 50*d* PBT staple fiber, the blending ratio R was set at 45% and the yarn count was 9S.

Using these blended spun yarns to create the pile in pile fabrics, two kinds of pile fabrics were produced by utilizing the weaving and finishing operations described in Example 1.

The furlike pile fabrics thus obtained were superior in that their guard hair covered the surface of the pile fabrics effectively, but the absence of tapers at the ends of the guard hair resulted in an artificial appearance and a hand which was not very smooth.

Moreover, the characteristics of the pile, such as fluttering were inferior to those of the fabrics of Example 1, because the roots of the guard hair, even those having long fiber length were not tapered and were not straight.

EXAMPLE 3

Two kinds of blended spun yarn were produced by using different kinds of PBT staple fiber, having fiber deniers of 10*d* and 85*d*, respectively, and a fiber length of 37 mm, and further having tapers on both ends as guard hair and using cotton fiber as underfur.

With 10*d* PBT staple fiber, the blending ratio R was set at 45% and the yarn count was 10S. With 85*d* PBT staple fiber, the blending ratio R was set at 50% and the yarn count was 7S.

Two kinds of pile fabrics were made by using these blended spun yarns to create pile in the fabrics, the continuity of each pile of the intermediate pile fabrics was separated and finishing operations of the thus produced pile fabrics were carried out as described in Example 1.

The 85*d* PBT staple fiber, resulted in a pile fabric having a coarse and rough hand. Accordingly, the characteristics and quality of the pile fabrics in this example were inferior to those of the excellent natural furlike pile fabric obtained according to the present invention in Example 1.

EXAMPLE 4

A core spun yarn having a yarn count of 16S (330*d*) and twist number of 540 T/m(Z) was produced with a conventional ring spinning machine by using rayon multifilament yarn of 210*d*–105*f* as underfur and roving yarn composed of PBT staple fibers 18*d*×35 mm having tapers on both ends as guard hair.

A rayon multifilament yarn of 50*d*–24*f* was plied with the above-mentioned core spun yarn and it was twisted to 500T/m in the S direction with a ring twister.

The yarn thus obtained had a yarn construction such that a rayon multifilament yarn 50*d*–24*f* was wrapped around a core spun yarn having substantially zero twist.

An intermediate pile fabric having a double velvet weave structure was produced with a double velvet weaving loom by using the yarn thus produced for creating connecting pile and polyester spun yarn 30/2S for creating the two ground constructions. The yarn densities of each ground construction were 44×44 (warp×weft) ends/inch, while the pile densities in the directions of warp and weft were 22×20 piles/inch, and the distance between the two ground constructions was 35 mm, in the intermediate pile fabric thus produced. Further, the position of the separating member was set at the center portion between two ground constructions and the continuity of the connecting pile was broken without cutting the guard hair staple fibers, while cutting the wrapping filament and underfur staple fibers. The separating member was provided with a blade having the configuation as shown in FIG. 10C in which the taper angle O was 15° and the length of the taper was 115 mm, this taper having a knife edge capable of cutting only the rayon filament.

The greige pile fabric thus obtained was subjected to backing with a 15% polyurethane dimethylformamide solution and then was washed, extracted and dried.

Finally, brushing and elimination of free fibers were carried out on the pile fabric.

The cut pile fabric thus obtained after drying and finishing treatment had a pile structure similar to that of genuine fur and showed natural mink like handling and appearance as depicted in FIG. 13.

EXAMPLE 5

A blended spun yarn having a yarn count of 8S and a twist number of 452 T/m (Z) was produced by a conventional cotton spinning system using 45% of PBT staple fiber 50*d*×33 mm (without $TiO_2$) as the first group of fibrous material for guard hair and using 55% of polyethylene terephthalate (hereinafter referred to as PET) staple fiber 1.5*d*×22 mm as the second group of fibrous material for underfur.

This spun yarn was then untwisted by 450 T/m (S) twist on a fancy twister and was simultaneously plied with a water soluble PVA filament yarn at 0% overfeed ratio.

The yarn thus produced was a yarn bundle having a yarn count of 8S, which had substantially no twist, with a wrapping of the water soluble PVA filament yarn.

A double velvet fabric was woven by using this yarn to create pile and by using 40S/2 spun yarn composed of 2*d*×51 mm island-in-sea typed conjugated staple fiber (island-sea ratio; island/sea=55/45, ultra fine fiber bundle composed of 11 filaments each having 0.1*d* obtainable from one island-sea type conjugated staple fiber after eliminating the sea component) to create two ground constructions. The double velvet fabric thus produced had the following construction:

| | |
|---|---|
| Length of the connecting pile; | 40 mm |
| Pile density (warp direction); | 30 pile units/inch |
| Pile density (weft direction); | 40 pile units/inch |
| Warp density of each ground construction; | 60 ends/inch |
| Weft density of each ground construction; | 60 ends/inch |
| Pile fixing construction; | fast pile system |

The separation of the upper and lower pile fabrics was performed by using a separating member of the type shown in FIG. 10A which could move forward and backward along the center portion of the alignment of the connecting pile and during such operation the continuation of the connecting pile was broken in such a manner that only PVA filament was cut, but PBT staple fibers and PET staple fibers were slide-separated without cutting or breaking. In this separating member, the angle 10° was 15° and the length of the taper was 115 mm, this taper edge not capable of cutting the fibers but capable of applying pressure to pile.

Consequently, two pile fabrics were produced.

Polyurethane solution was applied to the ground construction of the pile fabric thus produced and thereafter the water soluble PVA filaments were removed.

After drying, the pile fabrics were brushed for opening and finishing.

The pile fabrics thus produced had a pile structure wherein the pile fibers had a suitable distribution of fiber lengths and a distinctive two layered construction of thick PBT staple fibers having longer mean fiber length and of thin PET staple fibers having shorter mean fiber length.

The pile fabric was an excellent artificial fur very similar to genuine fur.

Moreover, the elimination of the PVA filaments made the ground construction very soft, the softness being enhanced after the sea component of the ground construction was removed.

EXAMPLE 6

A blended spun yarn having a yarn count of 10S and a twist of 12 T/in (Z) was produced by a conventional cotton spinning system using 70% of PBT staple fiber $30d \times 35$ mm, having tapers on both ends, as guard hair and using 30% of cotton fiber as a supplemental component for improving the spinning effect (referred to as the third fibrous material).

After applying a softening agent to this spun yarn, the spun yarn was twisted with PET filament yarn $300d$–$144f$ as underfur with 472 T/in (S) on a twisting machine.

A double velvet fabric was produced by using this twisted yarn to create the connecting pile, and using 30/2S spun yarn composed of PET staple fibers $2d \times 51$ mm to create two ground constructions. The construction of the double velvet fabric thus produced was as follows.

| | |
|---|---|
| Length of the connecting pile | 36 mm |
| Pile density (warp direction) | 22 pile units/inch |
| Pile density (weft direction) | 18 pile units/inch |
| Warp density of each ground construction | 44 ends/inch |
| Weft density of each ground construction | 36 ends/inch |
| Pile fixing construction | fast pile system such as one float over one weft in ground construction and 12 floats as pile |

Separation of the upper and lower pile fabrics was performed using a separating member provided with a blade which moved forward and backward along the center portion of the alignment of connecting pile.

The separating member was of a similar configuration to that shown in FIG. 10B wherein the taper angle $\theta$ was 5° and the length of the taper was 165 mm in which the 115 mm length from the tip of it had a sharp knife edge capable of cutting PET filament and following 50 mm length had only a dull edge.

The blade broke the continuity of the connecting pile in such a manner that the PET staple fibers and a part of cotton fibers were cut, and PBT staple fibers were slide-separated without cutting.

Accordingly, two pile fabrics were obtained. After obtaining such pile fabric, a backing treatment was performed by applying polyurethane emulsion to the ground construction, and after washing and drying operations, brushing treatment was applied to the pile of the pile fabric to open the pile. The pile fabric thus obtained had a pile construction such that the length of most of the pile fibers forming underfur were uniformly 18 mm while the fiber length of the pile fibers forming guard hair were varied with a distribution in which the length from a maximum length of 35 mm to a minimum of 0 mm.

The pile fabric thus produced had a natural mink like appearance and hand because this product had a two-layered pile structure composed of guard hair and underfur which could be distinguished. Moreover, this product had a soft hand and excellent fluttering characteristics.

Sulfuric acid treatment of this pile fabric to eliminate the cotton fibers from the pile further enhanced the appearance of the two layered structure by making the hand more similar to that of genuine mink.

EXAMPLE 7

A blended spun yarn having a yarn count of 10S and twist number of 473 T/m (Z) was produced by a conventional cotton spinning system by using 50% of PBT staple fiber $50d \times 31$ mm having tapers on both ends as guard hair, and by using 30% of PET staple fiber $4d \times 20$ mm as underfur and 20% of acrylic staple fiber $1.5d \times 38$ mm soluble in weakly alkaline liquid as the third fibrous material having suitable fiber length for improving the spinning ability.

This blended spun yarn was plied with water soluble PVA filament yarn of $50d$–$18f$. Then, this plied yarn was untwisted with 470 T/m (S) by a ring twister. A yarn in which water soluble PVA filament yarn spirally wrapped around the substantially non-twisted yarn was obtained.

A double velvet fabric was woven by using the yarn thus obtained to create the connecting pile and by using a 30/2S spun yarn composed of the $2d \times 51$ mm island-in-sea type conjugated staple fiber as mentioned in Example 5 to create the two ground constructions. The construction of the double velvet fabric thus produced was as follows:

| | |
|---|---|
| Length of the connecting pile | 32 mm |
| Warp yarn density of each ground construction | 44 ends/inch |
| Weft yarn density of each ground construction | 36 ends/inch |
| Pile yarn density (warp direction) | 22 ends/inch |
| Pile yarn density (weft | 18 ends/inch |
| Pile fixing construction | fast pile system the same as in Example 6 |

Separation of the upper and lower pile fabrics was performed by using a separating member provided with a blade which moved forward and backward along the center portion of the alignment of connecting pile as shown in FIGS. 9A and 9B.

The blade was of a similar configuration to that shown in FIG. 10B wherein the tip angle $\theta$ was 5° and the length of taper portion was 165 mm in which the portion having a 20 mm length from the tip had a knife edge and the next 95 mm length following this sharp portion, had a duller knife edge. The remaining 50 mm length had an edge capable of only applying pressure to the connecting pile.

The separating member broke the continuity of the connecting pile in such a manner that it cut only the water soluble PVA filaments and slide-separated at least a certain number of the PBT staple fibers without cutting.

This separated the upper and lower pile fabrics to produce two pile fabrics. The pile fabrics were then subjected to backing by using a polyurethane emulsion. The water soluble PVA filaments were then removed by hot water treatment, and the acrylic fibers were completely removed by a weakly alkaline emulsion.

The pile fabrics were washed, dried and then brushed to open the pile.

The pile fabrics thus obtained had pile structure wherein the length of the pile fibers in the pile were naturally distributed. The pile fiber length of the underfur varied from a maximum length of approximately zero, while that of the guard hair fibers varied from a maximum length of 28 mm to a minimum of approximately zero.

Consequently, the pile fabric obtained had a genuine mink like appearance and hand. The fabric had the distinctive two layer pile construction of guard hair and underfur. Furthermore, elimination of the sea component from the ground construction made the ground construction softer.

Accordingly, this made the pile fabric an excellent artificial fur very similar to genuine fur in feeling and appearance.

EXAMPLE 8

A blended spun yarn having a yarn count of 8S and a twist number of 452 T/m was produced by a conventional cotton spinning system by using 40% of PBT staple fiber 30d×33 mm and 60% of PET staple fiber 1.5d×20 mm.

This spun yarn was untwisted by 450 T/m(S) on a fancy twister and was simultaneously plied with a water soluble PVA filament yarn at an over-feed ratio of 25%.

This produced a yarn with a water-soluble PVA filament wrapped around a core fiber bundle of 8S of substantially zero twist.

A double velvet fabric was produced as in Example 5 using this yarn to create the pile and the same yarn as Example 5 for the two ground constructions. The construction of the above mentioned double velvet fabric was as follows:

| | |
|---|---|
| Length of the connecting pile | 40 mm |
| Pile yarn density (warp direction) | 30 pile units/inch |
| Pile yarn density (weft direction) | 40 pile units/inch |
| Warp density of each ground construction | 60 ends/inch |
| Weft density of each ground construction | 60 ends/inch |
| Pile fixing construction | fast pile system |

This double velvet fabric was then treated to remove the water soluble PVA filament. Elimination of the PVA filaments permits the easy separation of the upper pile fabric and lower pile fabric by applying a separating force to those fabrics without cutting the connecting pile. The pile fabric thus obtained had a pile structure wherein the pile had a suitable distribution of fiber length and a distinguishable two layer construction of guard hair and underfur. Elimination of the sea component from the ground construction yarn, as mentioned in Example 5, made the ground construction softer.

EXAMPLE 9

A blended spun yarn ($F_1$) having a yarn count of 10S and a twisting member of 473 T/m(Z) was produced by using 55% of cottom fiber as underfur and using 45% of PBT staple fiber having tapers on both ends as guard hair.

This spun yarn was then plied with a water soluble PVA filament yarn of 50d-18f and both yarns were simultaneously twisted by 470 T/m(S) on a fancy twister.

This produced a yarn ($F_2$) with a water soluble PVA filament yarn wrapped around a core fiber bundle of 10S of substantially zero twist composed of a first and second fibrous materials as shown in FIG. 6A. Next, two kinds of pile fabric were produced by using polyester spun yarn 30/2S for the two ground constructions and using either yarn $F_1$ or yarn $F_2$ as the connecting pile in a double velvet loom. This double velvet fabric had the following construction:

Warp and weft density of each ground construction (warp×weft) 44×36 ends/inch
Pile density (directions towards warp and weft) 22×18 ends/inch
Length of the connecting pile 32 mm The greige pile fabrics thus obtained were then subjected to backing with 15% polyurethane dimethylformamide emulsion, then were washed, extracted and dried.

Elimination of the PVA filaments was performed in the fabric produced with the yarn $F_2$, by hot water treatment at 80° C.

The pile fabrics were then brushed several times to open the pile and remove free fibers.

The weaving efficiency was poor with the yarn $F_1$. In weaving on the loom, the shed could not open smoothly due to some long fluffs of guard hair projecting from the pile. There was also large pile breakage and guard hair detachment.

When yarn $F_2$was used, weaving efficiency was excellent and fabric quality was also excellent because the type of problems occurring with the weaving of fabric with yarn $F_1$ were extremely small. In brushing, where yarn $F_2$ was used as pile, the pile was completely opened and free fibers were eliminated after 5 brushing repetitions.

On the other hand, where $F_1$ was used as pile, the pile was not opened sufficiently even after 12 brushing operations.

After drying and finishing, the pile fabric using yarn $F_2$ had a hand and appearance closer to genuine mink than did the pile fabric using yarn $F_1$.

EXAMPLE 10

A blended spun yarn having a yarn count of 10S and a twist number of 473 T/m(Z) was produced by a conventional cotton spinning system by using 45% of PBT staple fiber (no crimp) 40d×31 mm having tapers on both ends as guard hair and using 55% of PET staple fiber 1.5d×38 mm as underfur. This spun yarn was then plied with a water soluble PVA filament yarn of 50d–18f and both were simultaneously twisted by 470 T/m(S). This produced a yarn with a water soluble PVA filament yarn wrapped around a core fibrous bundle of 10S of substantially zero twist.

A double velvet fabric was produced by using this yarn to create connecting pile and using the spun yarn 30/2S composed of island-in-seal type conjugated staple fibers shown in Example 5 as the ground construction.

The length of the connecting pile was set at 32 mm and the other construction specifications of the fabric were also the same as in Example 7.

Separation of upper and lower pile fabrics was performed by using a separating member as shown in FIG. 10B which moved forward and backward along the alignment of the connecting piles as in Example 6.

According to the movement of the separating member, continuity of each connecting pile was slide-separated in such a manner that the water soluble PVA flament was surely cut almost of all PET staple fibers, both ends of which were fixed concurrently in both upper and lower base fabric and also were cut. Therefore, separation of upper and lower pile fabric could be accomplished and two sheets of pile fabrics could be obtained.

It must be noted that during separation, the blade of the separating member slide-separated almost all of the PBT staple fibers having tapers on both ends without cutting while cutting most of the 1.5d PET staple fibers because of their lower denier, even if one end was free.

EXAMPLE 11

A blended spun yarn having a yarn count of 16S/2 and a twist number of 560Z/443S T/m (initial twist/final twist) was produced by a conventional cotton spinning system by using 70% of PBT staple fiber 30d×35 mm and 30% of water soluble PVA staple fiber 1.0d×35 mm. A double velvet fabric ws produced by using this spun yarn as pile yarn to create connecting pile and by using 40S/2 spun yarn composed of 2d×51 mm island-in-sea type conjugated staple fibers in the two ground constructions, wherein the conjugated staple fibers consisted of PET as the island component and polystyrene as the sea component, (island/sea) was 55/45, ultra fine fiber bundle composed of 11 fibers each having 0.1d, after eliminating the sea component. The weave construction of this double velvet fabric was as follows:

| | |
|---|---|
| Length of the connecting pile; | 40 mm |
| Pile density (warp direction); | 40 pile units/inch |
| Pile density (weft direction); | 40 pile units/inch |
| Warp yarn density of each ground construction; | 80 ends/inch |
| Weft yarn density of each ground construction; | 60 ends/inch |
| Pile yarn fixing construction; | fast pile system |

The double velvet fabric was then subjected to hot water treatment to remove the PVA staple fibers, thereby loosening the interlace by the twists of component fibers of the connecting pile.

This loosening action enabled this double velvet fabric to be easily separated into two pile fabrics by applying a separating force to the ground constructions to slide-separate the PBT staple fibers without cutting. The pile fabric thus obtained had the following construction. The Length of the component pile fibers in each pile varies with a suitable distribution, which is preferable in an artificial fur, as shown in FIG. 11A.

We claim:

1. A yarn for use in manufacturing artifical fur having underfur and guard hairs comprising:

(a) a multiplicity of staple fibers having tapered ends, said fibers being of a denier and length useful to form guard hairs of the artificial fur, (b) blended with fibers (a) a multiplicity of at least one kind of fibers selected from the group consisting of (I) a staple fiber which is shorter and of less denier than said fibers (a) and being of a denier and length useful to form underfur of the artificial fur, and a fiber which is of less denier than said fibers and which has the capability of being easily cut into a staple fiber which is shorter than said fibers, and which is of a denier and length useful to form underfur of the artificial fur, said fibers (a) and (b) being relatively longitudinally slidable to separate at least some of the fibers from others of the fibers, and (c) temporary binding means connected to said fibers (a) and (b) to maintain them in continuity and resistant to longitudinal sliding separation during fabrication, whereby upon breaking or releasing the temporary binding means at least some of said fibers (a) and (b) may be longitudinally slidingly separated without being broken.

2. The yarn according to claim 1, wherein said fibers (a) and (b) comprise a fibrous bundle.

3. The yarn according to claim 2, wherein said fibrous bundle is composed of plurality of yarns of fiber (a) and fiber (b) respectively.

4. The yarn according to claim 3, wherein both fibrous bundles composed of the fiber (a) and (b) are spun yarns.

5. The yarn according to claim 3, wherein said fibrous bundle of the fiber (b) is a filament bundle.

6. The yarn according to the claim 5, wherein said fiber (b) of the fibrous bundle is a weak fiber.

7. The yarn according to claim 5 wherein said fibers (b) are a multifilament yarn.

8. The yarn according to claim 3, wherein said fibrous bundle is twisted.

9. The yarn according to claim 3, wherein said yarns are plied with each other.

10. The yarn according to claim 2, wherein said fibrous bundle is a blended fibrous bundle composed of the fibers (a) and (b).

11. The yarn according to claim 10, wherein said fibrous bundle is a blended spun yarn made of fibers (a) and (b).

12. The yarn according to the claim 11, wherein said fibrous bundle is a core spun yarn comprising fibers (a) and (b).

13. The yarn according to claim 1, wherein said binding means (c) is a weak yarn disposed around the pile fibers (a) and (b), whereby the fibers (a) and (b) may be liberated by the step of breaking the weak yarn thereby breaking the continuity of said pile fibers (a) and (b) by imparting tension along the fiber axes.

14. The yarn according to claim 13, wherein binding means (c) comprises an auxiliary yarn spirally surrounding a main portion of said fibers (a) and (b).

15. The yarn according to claim 14, wherein said auxiliary yarn is formed of a fibrous material having greater solubility than the fibers (a) and (b).

16. The yarn according to claim 1, wherein said binding means (c) is a soluble material positioned to unify the fibers (a) and (b), whereby the fibers (a) and (b) may be liberated by dissolving said binding means (c).

17. The yarn according to the claim 16, wherein said binding means (c) is a soluble yarn which is soluble in a solvent which does not dissolve the fibers (a) and (b).

18. The yarn according to claim 16, wherein a main portion of said fibers are partially adhered to each other or partially fixed to each other by melting.

19. The yarn according to claim 1 wherein said fibers (a) and (b) form a pile yarn, and wherein a main portion of said pile yarn is selected from a yarn having substantially zero twist and yarn provided with low twist.

20. The yarn according to claim 1, wherein said fibers (b) are provided with crimp.

21. The yarn according to claim 1, wherein said fibers (a) and (b) are further provided with a supplemental fibrous material in addition to said fibers (a) and (b).

22. The yarn according to claim 21, wherein said supplemental fibrous material is selected from the group consisting of multifilament yarns and staple fibers.

23. The yarn according to claim 21, wherein said supplemental fibrous material is a soluble fiber.

24. The yarn according to claim 21, wherein said supplemental fibrous material has such limited strength that it is easily broken by a force less than the force required to break the fibers (a) or (b).

25. The yarn according to claim 1, wherein said fibers (a) and (b) comprise a yarn provided with fibers so arranged therein that the free ends of the individual fibers are distributed at random therein.

26. The yarn according to claim 1, wherein said fibers (a) are provided with two tapered free ends and said two groups (a) and (b) satisfy the following relationship:

the fineness (D) of said fibers (a) material is in the following range defined by equation (1);

$$15 \leqq D \leqq 80 \qquad \text{Equation (1)}$$

the blend ratio (R) of said fibers (a) and (b) is in the following range defined by equation (2);

$$\frac{50D}{50+D} \leqq R \leqq \frac{450}{D} + 55 \qquad \text{Equation (2)}$$

wherein

D designates the denier of the thickest portion of each fiber (a),

R designates the blend ratio of said fibers (a) in % by weight and is defined by the equation $$R = \frac{A}{A+B} \times 100,$$

wherein

A designates the weight of said fibers (a) contained in a unit weight of said pile yarn, and B designates the weight of said fibers (b) contained in said unit weight of said pile yarn.

27. The yarn according to claim 1, wherein the length of the fibers (a) is in the range between 10 and 75 mm.

28. The yarn according to claim 27 wherein the length of fibers (a) is in the range between 15 and 30 mm.

29. The yarn according to claim 1, wherein the ratio between the length of fibers (a) and the length of fibers (b) is greater than 1 and smaller than 5.

30. The yarn according to claim 1, wherein the blend ratio of said fibers (a) and (b) is in arrange between 15% and 70%.

31. The yarn according to claim 1, wherein at least one of the fibers (a) or (b) is a splittable or separable fiber.

* * * * *

UNITED STATES PATENT AND TRADEMARK OFFICE

CERTIFICATE OF CORRECTION

PATENT NO. : 4,729,215

DATED : March 8, 1988

INVENTOR(S) : Kenji Sato, Seiichi Yamagata & Masaaki Sakai

It is certified that error appears in the above-identified patent and that said Letters Patent is hereby corrected as shown below:

IN THE CLAIMS:

Column 26, line 45, before "a" insert --(II)--.

Column 26, line 67, delete "fiber" and insert --fibers--.

Column 27, line 25, delete "pile".

Signed and Sealed this

Seventeenth Day of April, 1990

*Attest:*

*Attesting Officer*

HARRY F. MANBECK, JR.

*Commissioner of Patents and Trademarks*